US006979227B2

(12) United States Patent
Ikeda

(10) Patent No.: US 6,979,227 B2
(45) Date of Patent: Dec. 27, 2005

(54) CARD ADAPTER INCLUDING METALLIC COVER MEMBER CONNECTED TO GROUND

(75) Inventor: Yuichiro Ikeda, Miyagi-ken (JP)

(73) Assignee: ALPS Electric Co., Ltd., Tokyo ( * ) Notice: Subject to any disclaimer, the term of this patent is extended or adjusted under 35 U.S.C. 154(b) by 0 days.

(21) Appl. No.: 10/930,519

(22) Filed: Aug. 30, 2004

(65) Prior Publication Data

US 2005/0070165 A1 Mar. 31, 2005

(30) Foreign Application Priority Data

Sep. 29, 2003 (JP) ..... 2003-337908

(51) Int. Cl.[7] ..... H01R 24/00
(52) U.S. Cl. ..... 439/630; 439/159
(58) Field of Search ..... 439/630, 607, 439/108, 101, 76.1, 608, 159

(56) References Cited

U.S. PATENT DOCUMENTS 5,823,828 A * 10/1998 Bricaud et al. ..... 439/630
6,811,443 B2 * 11/2004 Machihara et al. ..... 439/630
6,840,807 B2 * 1/2005 Ooya et al. ..... 439/630
6,851,959 B2 * 2/2005 Ooya et al. ..... 439/159
2001/0010983 A1 * 8/2001 Bricaud et al. ..... 439/630
2002/0102882 A1 * 8/2002 Tanaka ..... 439/630
2004/0235353 A1 * 11/2004 Katsumata et al. ..... 439/630
2005/0095917 A1 * 5/2005 Miyamoto ..... 439/630

FOREIGN PATENT DOCUMENTS

JP 2000040131 A 2/2000

* cited by examiner

*Primary Examiner*—P. Austin Bradley
*Assistant Examiner*—Phuongchi Nguyen
(74) *Attorney, Agent, or Firm*—Beyer, Weaver & Thomas

(57) ABSTRACT

According to the present invention, there is provided a card adapter which is capable of preventing contact failure between a cover member and a ground terminal caused by the floating of the cover member when a card is inserted into a card inserting portion. A contacting surface 40 facing a back-end surface 1*b* of the card inserting portion 1*a* is provided on the ground terminal 12. A ground contacting portion 41 comprising a contacting portion 41*a* brought into contact with the contacting surface 40, a plate spring portion 41*b* extending in a widthwise direction of the card inserting portion 1*a* and bent in a lengthwise direction of the card inserting portion 1*a*, and a cantilever supporting portion 41*c* for supporting the plate spring portion 41*b* in a cantilever manner is formed in a bent portion 4*a* provided in a front-end portion of the cover member 4. In addition, in a lengthwise direction of the card inserting portion 1*a*, the contacting portion 41*a* of the ground contacting portion 41 is pressed against the contacting surface 40 of the ground terminal 12 to be brought into contact with each other through the elastic force of the plate spring portion 41*b*.

8 Claims, 6 Drawing Sheets

CARD ADAPTER INCLUDING METALLIC COVER MEMBER CONNECTED TO GROUND

BACKGROUND OF THE INVENTION

1. Field of the Invention

The present invention relates to a card adapter, connected to a ground, having a metallic cover member that covers a card inserting portion into which a card is inserted.

2. Description of the Related Art

Generally, each of card adapters typically comprise a card inserting portion, into which a card having an external terminal group exposed in a surface thereof is inserted, an adapter terminal group that is exposed in the interior and exterior of the card inserting portion and is brought into contact with the external terminal group of the card inserted into the card inserting portion, and a metallic cover member covering the card inserting portion and having a ground contacting portion which is brought into contact with a ground terminal of the adapter terminal group (for example, refer to Japanese Unexamined Patent Application Publication No. 2000-40131).

In such conventional card adapters, the cover member is arranged so as to be opposite to a bottom plate of the card inserting portion and the ground contacting portion of the cover member is brought into contact with the ground terminal in the thickness direction of the card inserting portion, to connect the cover member to the ground.

However, in the above-mentioned conventional card adapters, because the ground contacting portion of the cover member is brought into contact with the ground terminal in the thickness direction of the card inserting portion, when a card is inserted into the card inserting portion, the cover member often floats to cause contact failure between the ground contacting portion and the ground terminal. Further, as a result of having contact failure between the cover member and the ground terminal, the cover member cannot be connected to the ground. Thus, it is difficult to protect the card and the card adapter from static electricity or the like.

Accordingly, the present invention is designed to solve the above-mentioned problems, and it is an object of the present invention to provide a card adapter which is capable of preventing contact failure between a cover member and a ground terminal caused by the floating of the cover member when a card is inserted into a card inserting portion.

In order to achieve the above-mentioned object, the present invention provides a card adapter which comprises a card inserting portion into which a card having an external terminal group exposed in a surface thereof is inserted, an adapter terminal group that is exposed in the interior and exterior of the card inserting portion and is brought into contact with the external terminal group of the card inserted into the card inserting portion, and a metallic cover member covering the card inserting portion and having a ground contacting portion which is brought into contact with a ground terminal of the adapter terminal group. In addition, the ground contacting portion is brought into contact with the ground terminal in a lengthwise direction of the card inserting portion.

According to the present invention having the above-mentioned configuration, the ground contacting portion is brought into contact with the ground terminal in a lengthwise direction of the card inserting portion. For this reason, even when the cover member floats, the ground contacting portion is not separated from the ground terminal. Therefore, it is possible to prevent the contact failure between the cover member and the ground terminal caused by the floating of the cover member when the card is inserted into the card inserting portion.

In addition, according to the present invention, the ground terminal has a contacting surface facing a back-end surface of the card inserting portion, and the ground contacting portion is formed in a bent portion obtained by bending a front-end portion of the cover member. The ground contacting portion comprises a plate spring portion extending in a widthwise direction of the card inserting portion and bent in a lengthwise direction of the card inserting portion and a cantilever supporting portion for supporting the plate spring portion in a cantilever manner.

According to the present invention having the above-mentioned configuration, it is possible to press the ground contacting portion against the contacting surface of the ground terminal to be brought into contact with each other through elastic force of the plate spring portion. As a result, it is possible to stabilize the contact of the ground contacting portion to the ground terminal. In addition, since the plate spring portion of the ground contacting portion is formed so as to extend in the widthwise direction of the card inserting portion, it is possible to provide elasticity to the ground contacting portion without enlarging the size of the ground contacting portion in the thickness direction of the card inserting portion.

In addition, according to the present invention, the card adapter further comprises locking means for locking the cover member in a frame portion by sliding the cover member in a lengthwise direction of the card inserting portion in a state where the cover member is arranged at a predetermined position of the frame portion which forms sidewalls of the card inserting portion.

According to the present invention having the above-mentioned configuration, it is possible to easily assemble the cover member by the locking means.

In addition, according to the present invention, locating portions for locating the cover member in a thickness direction of the card inserting portion are formed in the cover member.

According to the present invention having the above-mentioned configuration, the cover member can be accurately arranged at a predetermined position in a thickness direction of the card inserting portion by the locating portions. As a result, the ground contacting portion can be accurately arranged toward the ground terminal.

As described above, according to the present invention, even when the cover member floats, the ground contacting portion is not separated from the ground terminal. As a result, when a card is inserted into the card inserting portion, it is possible to prevent contact failure between the cover member and the ground terminal from occurring. Therefore, it is possible to protect the card and the card adapter from static electricity or the like.

DESCRIPTION OF THE PREFERRED EMBODIMENTS

An embodiment of a card adapter of the present invention will now be described with reference to the accompanying drawings.

Figure 1:
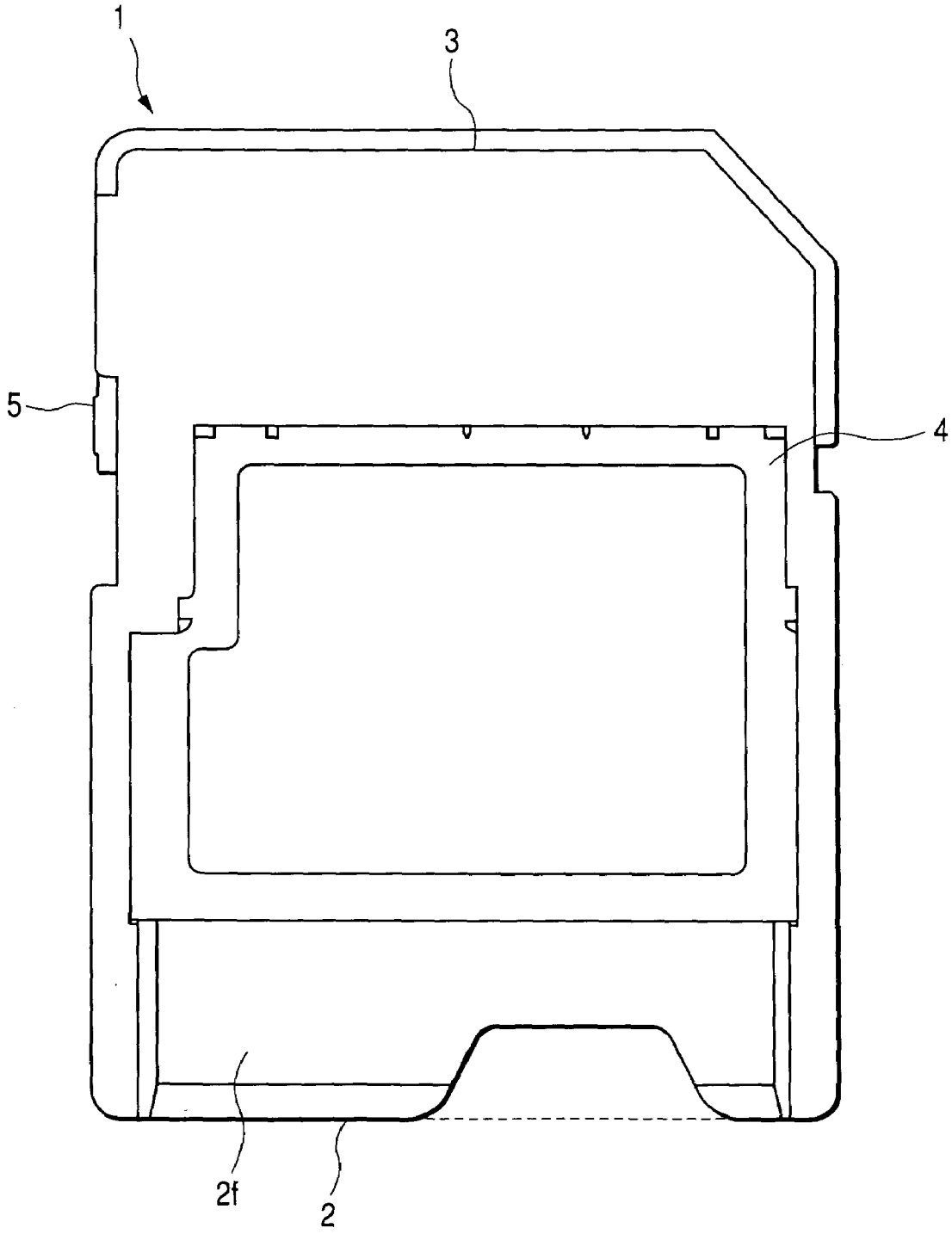
FIG. 1 is an enlarged plan view of a card adapter according to a first embodiment of the present invention.
Figure 2:
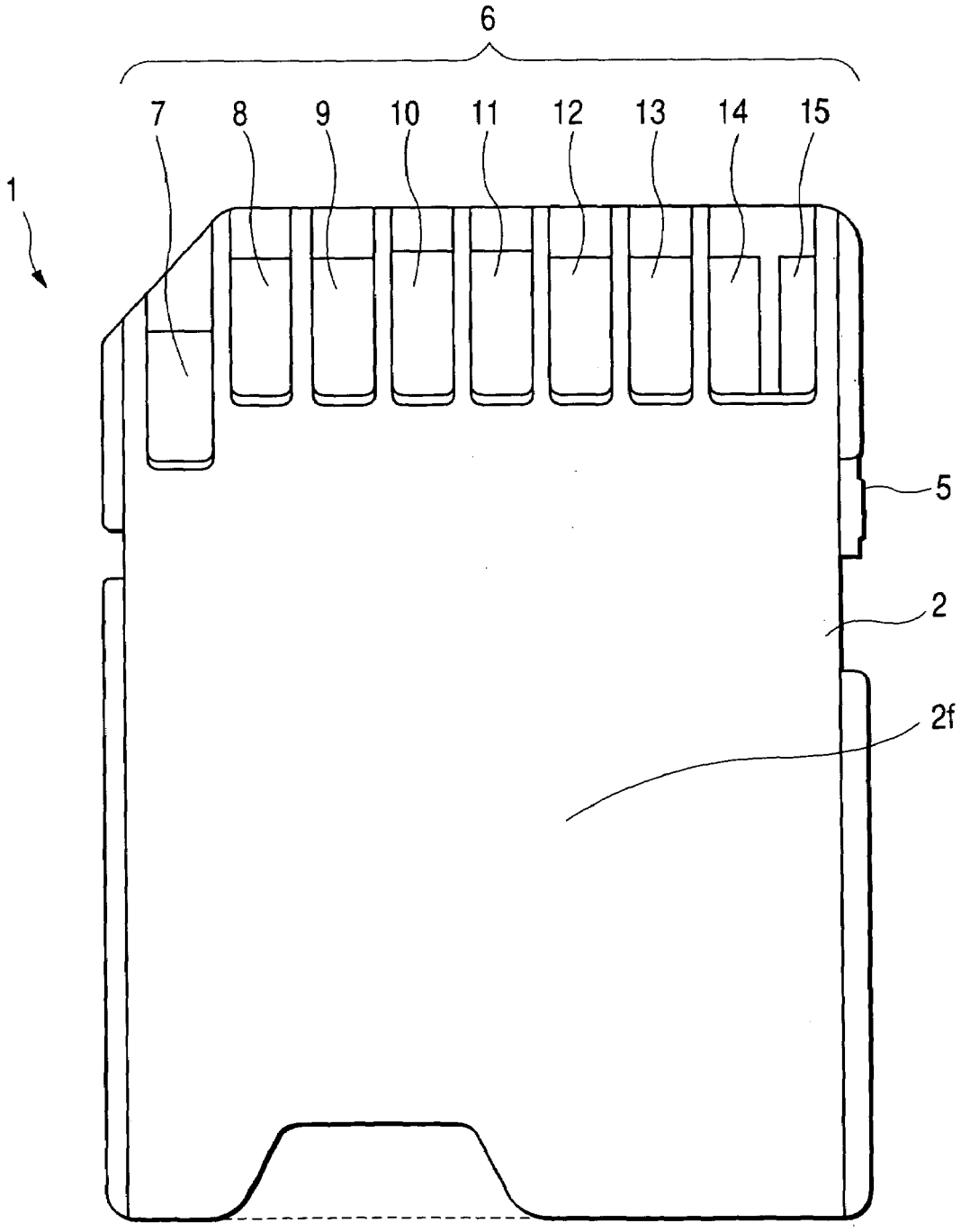
FIG. 2 is a back surface view of the embodiment shown in FIG. 1.
Figure 3:
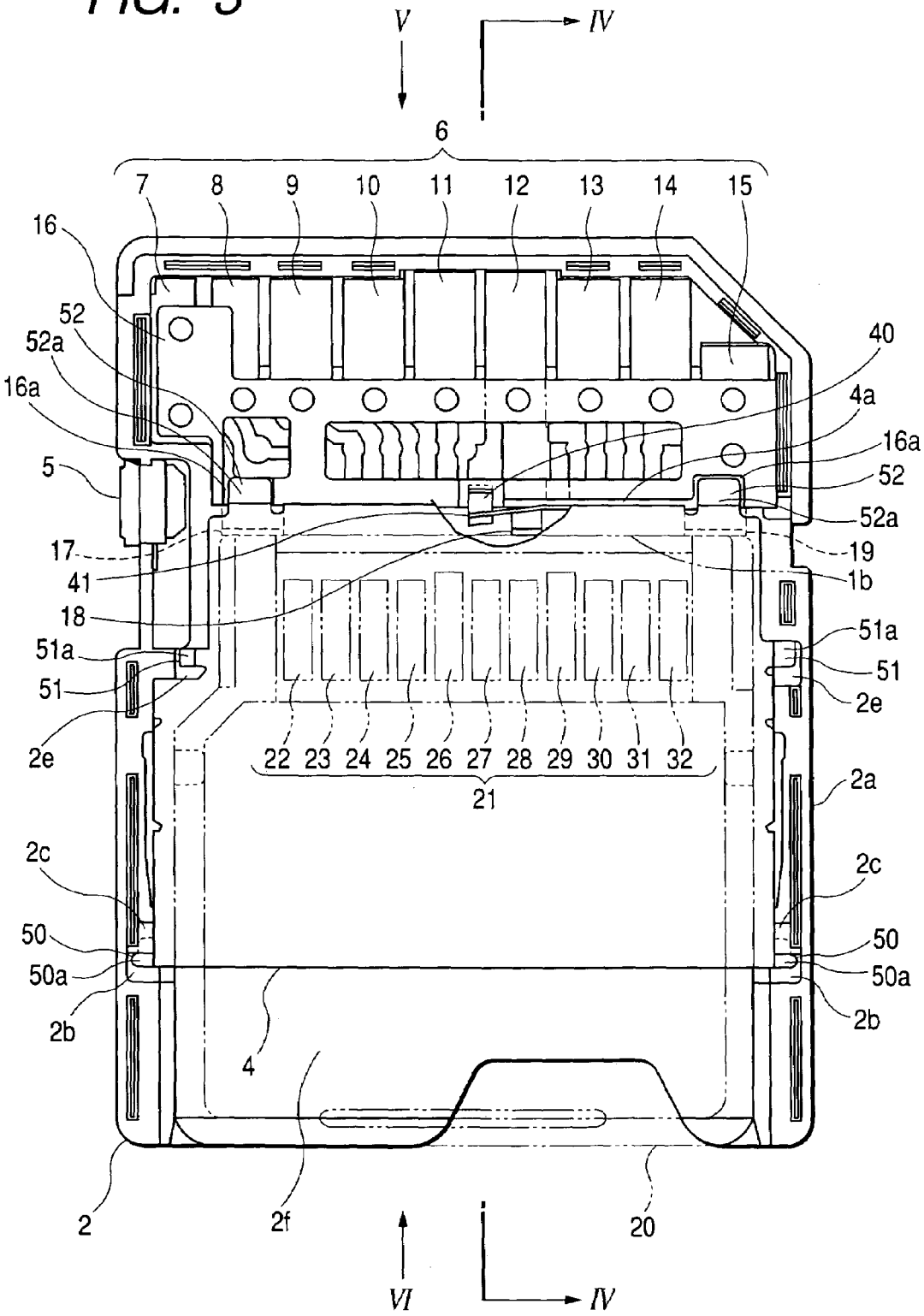
FIG. 3 is a plan view illustrating a state where an upper case is removed from the embodiment shown in FIG. 1.
Figure 4:
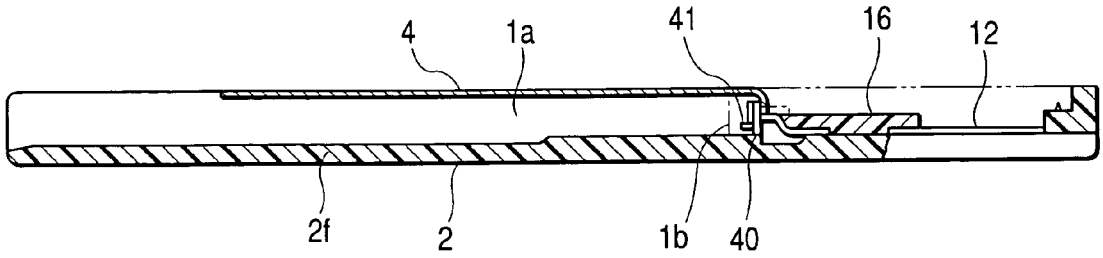
FIG. 4 is a sectional view taken along the line IV—IV of FIG. 3.
Figure 5:
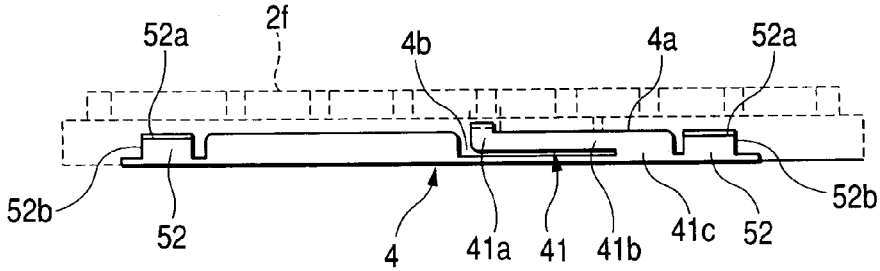
FIG. 5 is a view illustrating a case where a cover member shown in FIG. 3 is viewed from a direction V.
Figure 6:
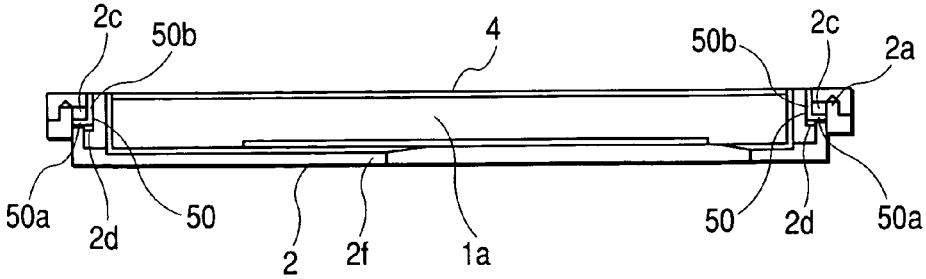
FIG. 6 is a view illustrating a case where the cover member shown in FIG. 3 is viewed from a direction VI.
Figure 7:
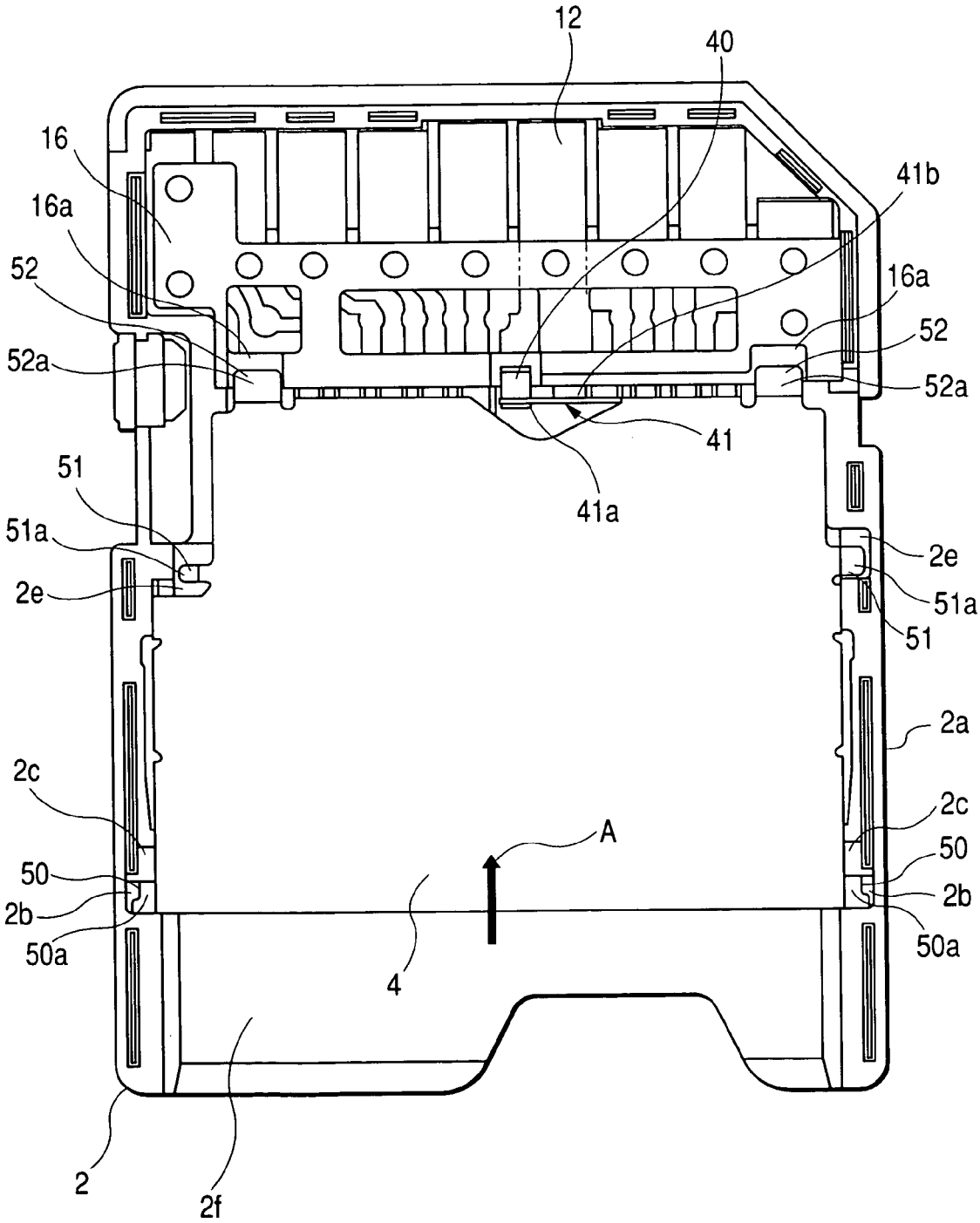
FIG. 7 is a plan view illustrating a state before the cover member is locked into a frame portion where the cover member is arranged on the frame portion of a lower case.
Figure 8:
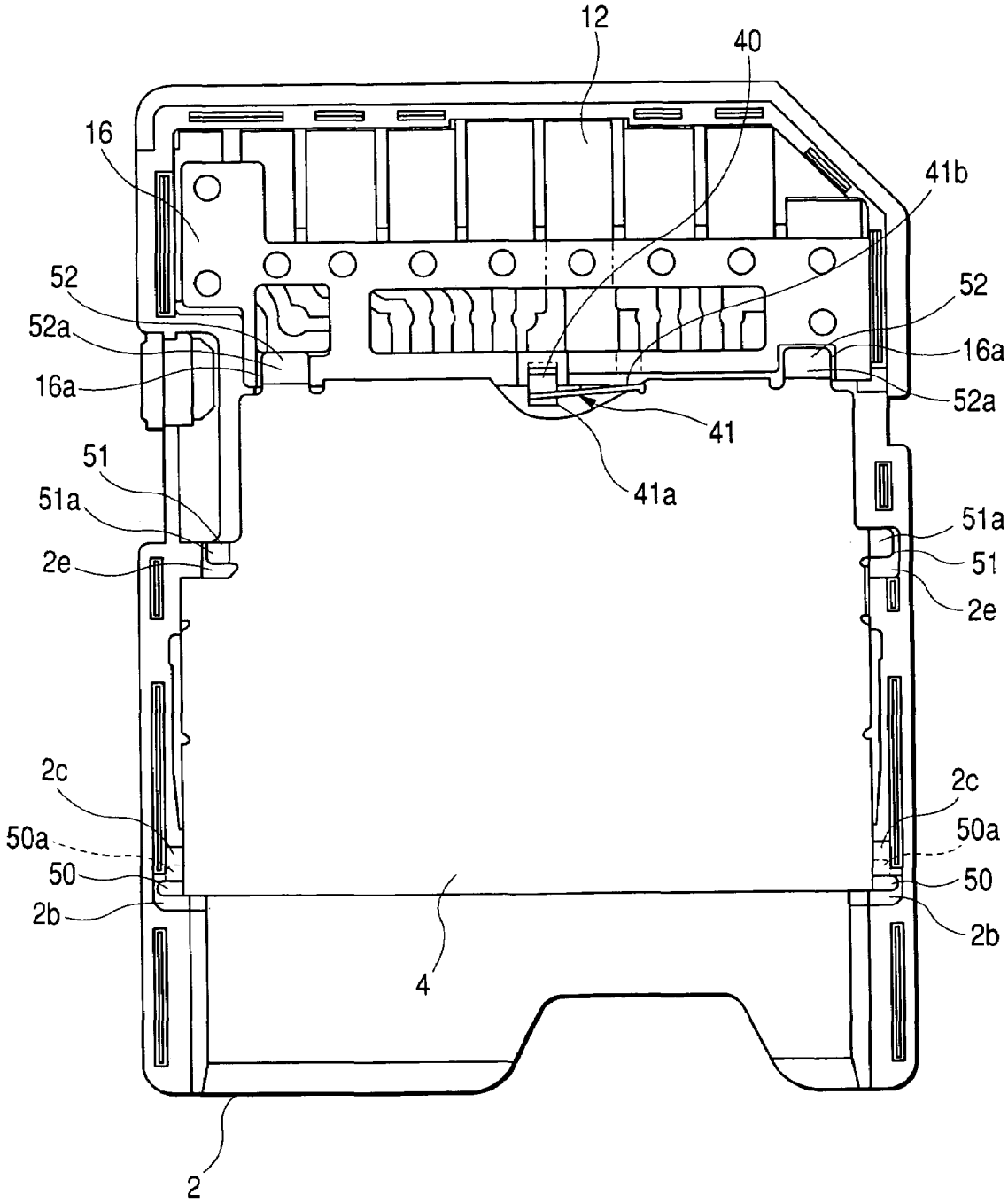
FIG. 8 is a plan view illustrating a state where the cover member is locked into the frame portion.

FIG. 1 is a plan view of a card adapter according to a first embodiment of the present invention; FIG. 2 is a back surface view of the embodiment shown in FIG. 1; FIG. 3 is a plan view illustrating a state where an upper case is removed from the embodiment shown in FIG. 1; FIG. 4 is a sectional view taken along the line IV—IV of FIG. 3; FIG. 5 is a view illustrating a case where the cover member shown in FIG. 3 is viewed from a direction V; FIG. 6 is a view illustrating a case where the cover member shown in FIG. 3 is viewed from a direction VI; FIG. 7 is a plan view illustrating a state before the cover member is locked into a frame portion where the cover member is arranged on the frame portion of a lower case; and FIG. 8 is a plan view illustrating a state where the cover member is locked into the frame portion.

The present embodiment relates to a card adapter 1 having an appearance shown in FIGS. 1 and 2. The card adapter 1 comprises a lower case 2 having a bottom plate 2*f* and sidewalls of a card inserting portion 1*a* (refer to FIGS. 4 and 6), a metallic cover member 4 attached to the lower case 2 for covering the card inserting portion 1*a* from the upper side, and an upper case 3 attached to the lower case 2 with a front-end and both sides of the cover member 4 interposed between the upper case 3 and the lower case 2.

An adapter terminal group 6 having a plurality of terminals 7 to 15 is exposed in the back surface of the lower case 2. The adapter terminal group 6 is brought into contact with a terminal group included in a card connector in a state where the card adapter 1 is inserted into the card connector (not shown). In addition, the reference numerals 5 in FIGS. 1 and 2 represent a sliding member for protecting a light.

As shown in FIG. 3, the adapter terminal group 6 is inserted into a wafer 16. The adapter terminal group 6 and the wafer 16 are fitted to a front portion of the lower case 2. In addition, the terminals 7 to 15 of the adapter terminal group 6 are exposed in the interior of the card inserting portion 1*a* (not shown).

In the card inserting portion 1*a*, a card, for example, a small SD card 20 is inserted. The small SD card 20 comprises an external terminal group 21 having a plurality of external terminals 22 to 32 exposed in a surface thereof. The external terminal group 21 and the adapter terminal group 6 are brought in contact with each other in a state where the small SD card 20 is inserted into the card inserting portion 1*a*.

In addition, in the lower plate 2*f* of the lower case 2, stopper portions 17, 18 and 19 are provided. The stopper portions 17, 18, and 19 are brought in contact with the front-end surface of the small SD card 20 in the card inserting portion 1*a*, and define an insertion finishing position where the insertion of the small SD card 20 into the card inserting portion 1*a* is finished.

Specifically, in the present embodiment, a ground contacting portion 41 that is provided in the cover member 4 and is brought in contact with the ground terminal 12, is brought in contact with the ground terminal 12 that is included in the adapter terminal group 6 and is connected to the ground in the lengthwise direction of the card inserting portion 1*a*.

As shown in FIGS. 3 and 4, a contacting surface 40 that protrudes from the lower plate 2*f* of the lower case 2 upward and faces the back end surface 1*b* of the card inserting portion 1*a* is formed on the ground terminal 12, and the ground contacting portion 41 formed at the front-end portion of the cover member 4 is brought in contact with the contacting surface 40.

As shown in FIG. 5, the ground contacting portion 41 is formed at a bent portion 4*a* that is obtained by bending the front-end portion of the cover member 4 at nearly a right angle toward the lower plate 2*f* of the lower case 2. In other words, by using a notch 4*b* obtained by cutting out the front-end portion of the cover member 4 in an L shape, a plate spring portion 41*b* extending in a widthwise direction of the card inserting portion 1*a* and bent in a lengthwise direction of the card inserting portion 1*a*, a cantilever supporting portion 41*c* for supporting the plate spring portion 41*b* in a cantilever manner, and a contacting portion 41*a* located at the front-end of the plate spring portion 41*b* and brought in contact with a contacting surface 40 of the ground terminal 12 are formed.

Specifically, in the present embodiment, a pair of engaging pawls 50 is provided on rear ends of both sides of the cover member 4, as shown in FIG. 3. As shown in FIG. 6, the engaging pawls 50 comprises locating portions, obtained by bending side end portions of the cover member 4, for locating the rear-end portion of the cover member 4 at a predetermined position in the thickness direction of the card inserting portion 1*a*, that is, leg portions 50*b*, and pawl portions 50*a* expanding toward the outside of the card inserting portion 1*a* at the front ends of the leg portions 50*b*.

In addition, as shown in FIG. 3, a pair of concave portions 2*b* in which the pawl portions 50*a* of the engaging pawls 50 is disposed is provided on the rear portions of both sides of the frame portion 2*a* of the lower case 2, respectively. As shown in FIG. 6, a pair of flange portions 2*c*, protruding toward the card inserting portion 1*a* side, is formed in the frame portions 2*a*. Further, transverse grooves 2*d*, communicating with the concave portions 2*b*, into which the pawl portions 50*a* of the engaging pawls 50 are fitted, are formed under the pair of flange portions 2*c*, respectively. In addition, sizes of the concave portions 2*b* and sizes of the pawl portions 50*a* in a lengthwise direction of the card inserting portion 1*a* are set such that they are substantially equal to each other.

In other words, in a state where the cover member 4 is located at a predetermined position of the frame portion 2*a* forming the sidewalls of the card inserting portion 1*a*, that is, a position at which each pawl portion 50*a* is disposed in each concave portion 2*b*, when the cover member 4 is slid in a lengthwise direction of the card inserting portion 1*a*, that is, a direction of an arrow A (see FIG. 7), each pawl portion 50*a* is fitted into each transverse groove 2*d*. In other words, locking means is constituted for locking the cover member 4 in the fame portion 2*a* by the pawl portions 50*a* and the transverse grooves 2*d*.

In addition, as shown in FIG. 3, a pair of engaging tongues 51 is formed in the middle of both sides of the cover member 4. The engaging tongues 51 are formed by bending the side end portions of the cover member 4. The engaging tongues 51 comprise locating portions for locating the center portion of the cover member 4 at a predetermined position in the thickness direction of the card inserting portion 1*a*, that is, leg portions (not shown), and tongue portions 51*a* expanding toward the outside of the card inserting portion 1*a* at the front ends of the leg portions.

In addition, the tongue portions 51*a* of the engaging tongues 51 are formed in the middle of both sides of the frame portion 2*a*, respectively. A pair of concave portions 2*e* is formed for allowing the tongue portions 51*a* to be slid by a predetermined distance in a lengthwise direction of the card inserting portion 1*a*.

In addition, a pair of engaging tongues 52 is formed at both sides of the front-end portion of the cover member 4. The engaging tongues 52 are formed by bending the front-end portion of the cover member 4. The engaging tongues 52 comprise locating portions for locating the front-end portion of the cover member 4 at a predetermined position in the thickness direction of the card inserting portion 1*a*, that is, leg portions 52*b*, and tongue portions 52*a* expanding toward the outside of the card inserting portion 1*a* at the front ends of the leg portions 52*b*.

In addition, the tongue portions 52*a* of the engaging tongues 52 are arranged at a rear-end portion of the wafer 16. A pair of concave portions 16*a* is formed for allowing the tongue portions 52*a* to be slid by a predetermined distance in a lengthwise direction of the card inserting portion 1*a* at the rear-end portion of the wafer 16.

In the present embodiment having the above-mentioned configuration, when the cover member 4 is attached to the lower case 2, firstly, the pawl portions 50*a* of the engaging pawls 50 are arranged in the concave portions 2*b* and then the tongue portions 51*a* of the engaging tongues 51 and the tongue portions 52*a* of the engaging tongues 52 are arranged in the concave portions 2*e* and 16*a*, respectively, as shown in FIG. 7.

At this time, since the sizes of the concave portions 2*b* and the sizes of the pawl portions 50*a* in a lengthwise direction of the card inserting portion 1*a* are substantially equal to each other, when the pawl portions 50*a* are arranged in the concave portions 2*b*, the tongue portions 51 and 52 are simultaneously arranged in the concave portions 20*e* and 16*a*, respectively.

As such, when the pawl portions 50*a* of the engaging pawls 50, the tongue portions 51*a* of the engaging tongues 51, and the tongue portions 52*a* of the engaging tongues 52 are arranged respectively in the concave portions, the rear-end portion, center portion, and front-end portion of the cover member 4 are located respectively at predetermined positions in a thickness direction of the card inserting portion 1*a* by leg portions 50*b* of the engaging pawls 50, leg portions of the engaging pawls 51, and leg portions 52*b* of the engaging pawls 52.

Next, as described above, in a state where the cover member 4 is arranged in the frame portion 2*a*, the cover member 4 is slid in a lengthwise direction of the card inserting portion 1*a*, that is, a direction of an arrow A. If so, as shown in FIG. 8, the tongue portions 51*a* of the engaging tongues 51 and the tongue portions 52*a* of the engaging tongues 52 are slid in a direction of an arrow A in the concave portions 2*e* and 16*a* of the frame portion 2*a*, respectively. At this time, specifically, the pawl portions 50*a* of the engaging pawls 50 are slid under the flange portions 2*c*, that is, are fitted into the transverse grooves 2*d*. As a result, the cover member 4 is locked into the frame portion 2*a*. In other words, the cover member 4 is temporarily fixed to the lower case 2.

Next, the upper case 3 is attached to the lower case 2 from the upper side of the cover member 4 that is temporarily fixed to the lower case 2, as describe above. At this time, the tongue portions 51*a* of the engaging tongues 51 are sandwiched between the frame portion 2*a* of the lower case 2 and the side portions of the upper case 3 in the concave portions 2*e*. The tongue portions 52*a* of the engaging tongues 52 are sandwiched between the wafer 16 and the front portion of the upper case 3 in the concave portions 16*a*. As a result, the floating of the cover member 4 from the lower case 2 can be suppressed.

Furthermore, as shown in FIG. 7, in the state where the cover member 4 is arranged at the frame portion 2*a*, the ground contacting portion 41 of the cover member 4 is in the vicinity of the contacting surface 40 of the ground terminal 12. In addition, when the cover member 4 is slid in a direction of an arrow A, the contacting portion 41*a* of the ground contacting portion 41 is pressed against the contacting surface 40 of the ground terminal 12 and thus the plate spring portion 41*b* is bent, as shown in FIG. 8. In other words, in the ground contacting portion 41, the contacting portion 41*a* is brought into contact with the contacting surface 40 of the ground terminal 12 through the elastic force of the plate spring portion 41*b*.

According to the present embodiment, the following effects are obtained.

According to the present embodiment, the contacting portion 41*a* of the ground contacting portion 41 is brought into contact with the contacting surface 40 of the ground terminal 12 in the lengthwise direction of the card inserting portion 1*a*. For this reason, even when the cover member 4 floats, the ground contacting portion 41 is not be separated from the ground terminal 12. As a result, when a card is inserted into the card inserting portion 1*a*, it is possible to prevent the contact failure between the cover member 4 and the ground terminal 12 from occurring. Consequently, the card and the card adapter can be protected from static electricity or the like.

Further, according to the present embodiment, since the ground contacting portion 41 comprises a plate spring portion 41*b* that is bent in the lengthwise direction of the card inserting portion 1*a* and is supported by the cantilever supporting portion in a cantilever manner, it is possible to press the contacting portion 41*a* against the contacting surface 40 of the ground terminal 12 to be brought into contact with each other through elastic force of the plate spring portion 41*b*. As a result, it is possible to stabilize the contact of the ground contacting portion 41 to the ground terminal 12. Consequently, the card and the card adapter can be protected from static electricity or the like.

Furthermore, according to the present embodiment, the plate spring portion 41*b* of the ground contacting portion 41 is formed so as to extend in the widthwise direction of the card inserting portion 1*a*. As a result, it is possible to provide elasticity to the ground contacting portion 12 without enlarging the ground contacting portion 12 in the thickness direction of the card inserting portion 1*a*. Therefore, the card adapter 1 need not be increased in size.

Furthermore, according to the present embodiment, by having the locking means, that is, the pawl portions 50*a* of the engaging pawls 50 and the transverse grooves 2*d* of the frame portion 2*a*, when the cover member 4 is slid in a direction in which the cover member 4 is inserted, the cover member 4 is locked into the frame portion 2*a*. As a result, the cover member 4 can be temporarily fixed to the lower case 2 more easily. Therefore, it is possible to easily assemble the cover member 4.

Furthermore, according to the present embodiment, by having the locating portions, that is, the leg portions 50*b* of the engaging pawls 50, the leg portions of the engaging tongues 51, and the leg portions 52*b* of the engaging tongues 52, the cover member 4 can be accurately arranged at a predetermined position in the thickness direction of the card inserting portion 1*a*. As a result, the contacting portion 41*a* of the ground contacting portion 41 can be accurately arranged on the contacting surface 40 of the ground terminal 12. Therefore, it is possible to stabilize the contact of the ground contacting portion 41 to the ground terminal 12 and to consequently protect the card and the card adapter from static electricity or the like.

What is claimed is:

1. A card adapter, comprising:

a card inserting portion into which a card having an external terminal group exposed in a surface thereof is inserted;

an adapter terminal group that is exposed in the interior and exterior of the card inserting portion and is brought into contact with the external terminal group of the card inserted into the card inserting portion; and a metallic cover member covering the card inserting portion and having a ground contacting portion which is brought into contact with a ground terminal of the adapter terminal group, wherein the ground terminal has a contacting surface facing a back-end surface of the card inserting portion, wherein the ground contacting portion is formed in a bent portion obtained by bending a front-end portion of the cover member, wherein the ground contacting portion comprises a plate spring portion extending in a widthwise direction of the card inserting portion and bent in a lengthwise direction of the card inserting portion and a cantilever supporting portion for supporting the plate spring portion in a cantilever manner, and wherein the ground contacting portion is brought into contact with the ground terminal in a lengthwise direction of the card inserting portion.

2. The card adapter according to claim 1, wherein locating portions for locating the cover member in a thickness direction of the card inserting portion are formed in the cover member.

3. The card adapter according to claim 2, wherein the locating portions are a plurality of leg portions provided in the cover member.

4. The card adapter according to claim 1, further comprising:

locking means, wherein the locking means locks the cover member in a frame portion by sliding the cover member in a lengthwise direction of the card inserting portion in a state where the cover member is arranged at a predetermined position of the frame portion which forms sidewalls of the card inserting portion.

5. The card adapter according to claim 4, wherein the locking means comprises transverse grooves communicating with a pair of concave portions provided in a lower case and pawl portions of a pair of engaging pawls of the cover member.

6. The card adapter according to claim 4, wherein the locking means comprises transverse grooves communicating with a pair of concave portions provided in a lower case and pawl portions of a pair of engaging pawls of the cover member.

7. The card adapter according to claim 4, wherein locating portions for locating the cover member in a thickness direction of the card inserting portion are formed in the cover member.

8. The card adapter according to claim 7, wherein the locating portions are a plurality of leg portions provided in the cover member.

* * * * *